US005149192A

United States Patent [19]

Hamm et al.

[11] Patent Number: 5,149,192

[45] Date of Patent: Sep. 22, 1992

[54] SYSTEM FOR MIXING CEMENTITIOUS CONSTRUCTION MATERIALS

[75] Inventors: Alton B. Hamm, Fort Worth; Grover C. Ratliff, Hurst, both of Tex.

[73] Assignee: Mixer Products, Inc., Forth Worth, Tex.

[21] Appl. No.: 678,066

[22] Filed: Apr. 1, 1991

Related U.S. Application Data

[63] Continuation of Ser. No. 252,379, Sep. 30, 1988, abandoned.

[51] Int. Cl.[5] ..... B01F 7/18

[52] U.S. Cl. ..... 366/8; 366/152; 366/16; 366/43; 366/134

[58] Field of Search ..... 366/150, 151, 152, 153, 366/154, 160, 162, 181, 182, 185, 189, 141, 142, 132, 134, 42, 43, 16–26, 29, 30, 38, 65, 66, 8

[56] References Cited

U.S. PATENT DOCUMENTS

| | | | |
|---|---|---|---|
| 736,389 | 8/1983 | Haskins | 366/31 |
| 1,152,820 | 9/1915 | Kennicott | 366/155 |
| 1,565,688 | 7/1922 | Tranaas | 212/197 |
| 1,577,635 | 3/1926 | Essick | 366/45 |
| 1,699,230 | 1/1929 | Eberling | 366/42 |
| 1,724,033 | 3/1926 | Lichtenberg | 366/14 |
| 2,015,488 | 9/1935 | Manabe | 366/18 |
| 3,305,222 | 2/1967 | Foster | 366/35 |
| 3,306,589 | 2/1967 | Uden | 366/16 |
| 3,343,688 | 9/1967 | Ross | 366/18 |
| 3,451,659 | 6/1969 | Tobolov et al. | 366/27 |
| 3,625,489 | 12/1971 | Weaver | 366/24 |
| 3,658,301 | 4/1972 | Brunsing et al. | 366/162 |
| 3,942,772 | 3/1976 | Smith | 366/26 |
| 3,995,839 | 12/1976 | Zingg | 366/154 |
| 4,023,776 | 5/1977 | Greten | 366/154 |
| 4,187,030 | 2/1980 | Godley | 366/319 |
| 4,272,824 | 6/1981 | Lewinger et al. | 366/141 |
| 4,334,786 | 6/1982 | Delcoigne et al. | 366/154 |
| 4,339,202 | 7/1982 | Hart et al. | 366/18 |
| 4,339,204 | 7/1982 | Placzek | 366/18 |
| 4,367,953 | 1/1983 | Hinz et al. | 366/132 |
| 4,390,282 | 6/1983 | Bake | 366/181 |
| 4,406,548 | 9/1983 | Haws | 366/8 |
| 4,409,096 | 10/1983 | O'Brian | 366/151 |
| 4,488,815 | 12/1984 | Black | 366/17 |
| 4,544,279 | 10/1985 | Rudolph | 366/162 |
| 4,548,507 | 10/1985 | Mathis et al. | 366/20 |
| 4,580,902 | 4/1986 | Dunstan | 366/42 |
| 4,660,987 | 4/1987 | Robinson | 366/67 |
| 4,667,503 | 5/1987 | Loos | 366/141 |

FOREIGN PATENT DOCUMENTS

| | | | |
|---|---|---|---|
| 592454 | 2/1978 | U.S.S.R. | 366/16 |

OTHER PUBLICATIONS

The Magazine of Masonry Construction, Jul. 1988, pp. 164–191.

*Primary Examiner*—Frankie L. Stinson

*Attorney, Agent, or Firm*—Hubbard, Thurman, Tucker & Harris

[57] ABSTRACT

A system which includes method and apparatus for the delivery of cementitious materials to a construction site using a transportable machine, a truck with an extensible crane, a containment frame, and transport cement silos that are carried by the truck and used to replenish cement. The machine has a frame with extensible legs and includes a cement storage and conveyor means having an agitator to assure the delivery of cement of uniform consistency to a batch mixer that has arms to rotate mix in a rotational loop. A water storage and conveyor means utilizes a constant head of water, a solenoid operated valve and a manually operated adjustment means to assure the delivery of water at a uniform flow rate to the batch mixer means. Sand of uniform density and consistency is delivered by a belt conveyor having a compression plate to compress the sand to a uniform density. The control system operates each of the above storage and conveyor means in a manner that enables the operator to select any volume within a given range which volume will contain constituents of a uniform ratio. The quantity of cement and sand in the system is monitored and controlled by a sensor and indicator means to enable dependability of operation.

31 Claims, 11 Drawing Sheets

SYSTEM FOR MIXING CEMENTITIOUS CONSTRUCTION MATERIALS

This application is a continuation of application Ser. No. 252,379, filed Sep. 30, 1988, now abandoned.

BACKGROUND OF THE INVENTION

1. Field of the Invention

This invention relates to systems—including methods and apparatus—for mixing cementitious construction materials such as mortar and grout; specifically to portable systems that mix these materials at the construction sites.

2. Description of the Prior Art

An anachronism exists in construction projects where masonry or stone structures are being constructed with cementitious material such as mortar. Construction workers often manually mix sand, cement and water with shovel and wheel barrow, or sometimes in a rotating mixer, to produce mortar or grout. The quality of the mixed constituents varies widely from batch to batch—and the quality of the finished product ranges from excellent to poor.

The problem has been noticed for years by past inventors, but the proposed solutions have not produced a replacement method or system that is sufficiently economical and accurate. There are a variety of machines which address the problems, but complexities arise due to the physical properties of the constituents. Sand increases in volume in the presence of moisture or "fluffys" in the language of the trade. Cement can assume the properties of a powder, a liquid or a cake depending upon it physical condition or treatment. Consequently, the delivery mechanisms sometimes fail to convey uniform flow rates or volumes to the mixer of the constituents. This can cause the ratio of constituents to vary from the predetermined value or acceptable range. Further, the controls are seemingly inadequate to produce the requisite consistency and uniformity.

Unfortunately, the construction workers often toil as yet with inadequate tools, achieving inconsistent and unpredictable results.

SUMMARY OF THE INVENTION

It is the general object of this invention to provide a system which includes improved methods and apparatus for mixing cementitious construction material such as mortar or grout.

The objects of the invention are achieved by the provision of a truck-mounted machine having extensible legs for deposit of the machine at a construction site and the use of the truck for delivering additional cement by use of a cement silo containment frame and multiple cement transport silos. The truck has an extensible and rotatable crane such that the transport silos may be positioned individually above the machine for the introduction of cement.

The machine has cement storage and conveyor means, sand storage and conveyor means and water storage and conveyor means which can deliver constituents at accurate flow rates and in accurate volumes to a batch mixer where the constituents are individually deposited and mixed.

The cement storage and conveyor means utilizes an agitator which assures the delivery of cement of consistent density to the associated conveyor and to the batch mixer.

The water storage and conveyor means utilizes a water supply of constant head and an adjustable valve to accurately control the volume of water flowing to the batch mixer.

Accurate volumes of sand are delivered with a sand storage and conveyor means having a compression plate to eliminate "fluff" and other variations to assure the delivery of uniform density and volumes of sand to the batch mixer.

The batch mixer utilizes a mixing arm having a configuration to mix the cementitious material thoroughly into a uniform consistency.

The cement transport silos utilize a door arrangement which automatically opens when tension is relieved from a lift rod engaged by the extensible crane 23.

The electrical control system utilizes an operator input means, including a volume selector, to enable the operator to select any desired volume of mix within a given range. Once selected, a constant volume is delivered to the mixture by the various conveyor means at uniform rates to assure accurate mixture ratios. Variation in the quantity of water in the mixture is provided for in a convenient manner. The rate of flow of cement can be varied by use of a supplemental and locked controller to be adjusted only by authorized personnel.

Additional objections and features of advantage will become apparent in the following description.

DESCRIPTION OF THE PREFERRED EMBODIMENT

Figure 1:
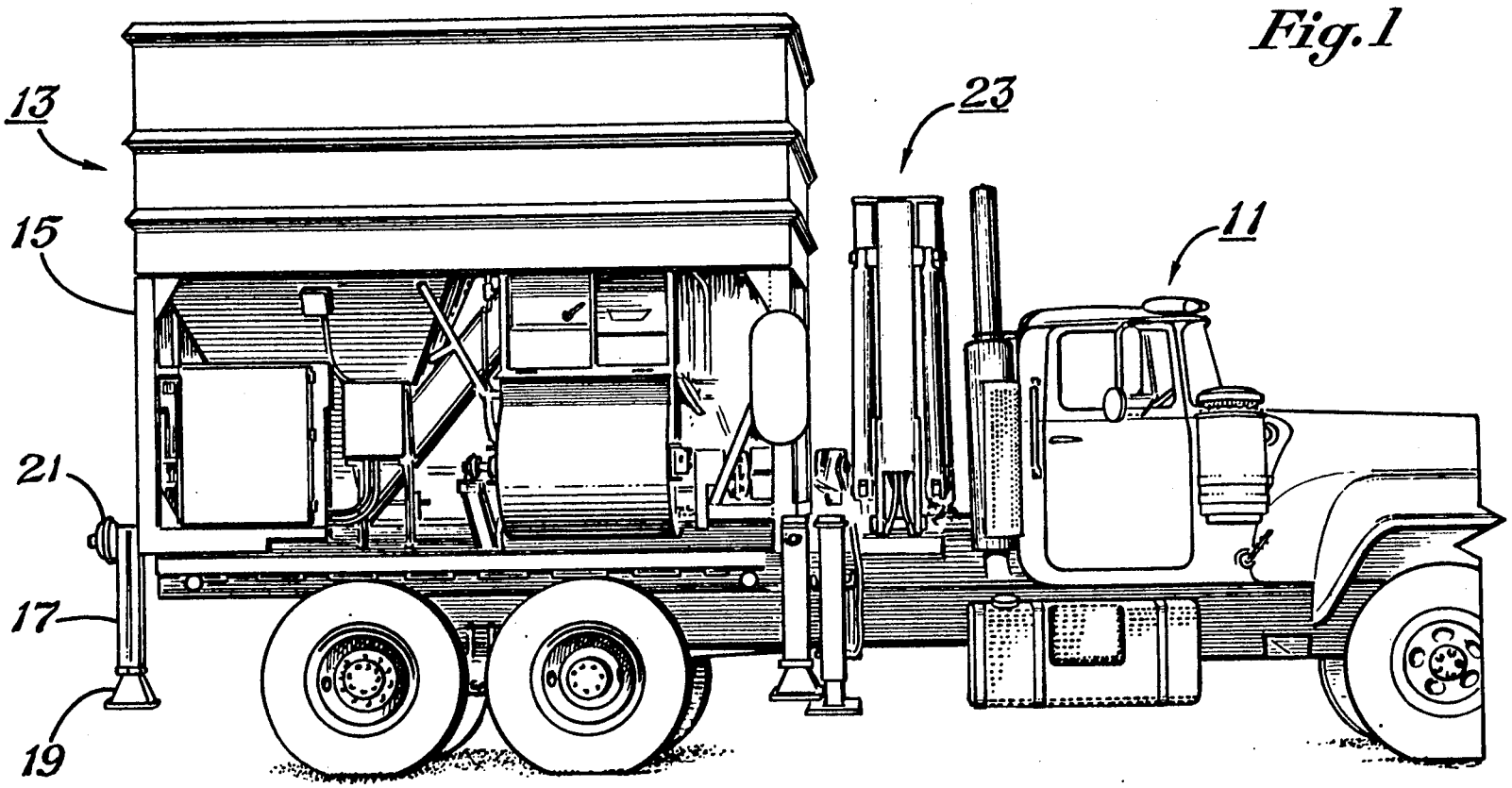
FIG. 1 is a side elevational view of a truck mounted portable machine for mixing cementitious material.

Referring initially to FIG. 1 of the drawings, the numeral 11 designates a truck which supports a machine 13 for mixing constituents of cementitious construction material, the machine frame 15 having at each corner an extensible leg 17 and footing 19, which is raised or lowered by a gear box 21 that may be manually operated, but is preferably operated with a hand held electric rotating tool (not shown).

Figure 2:
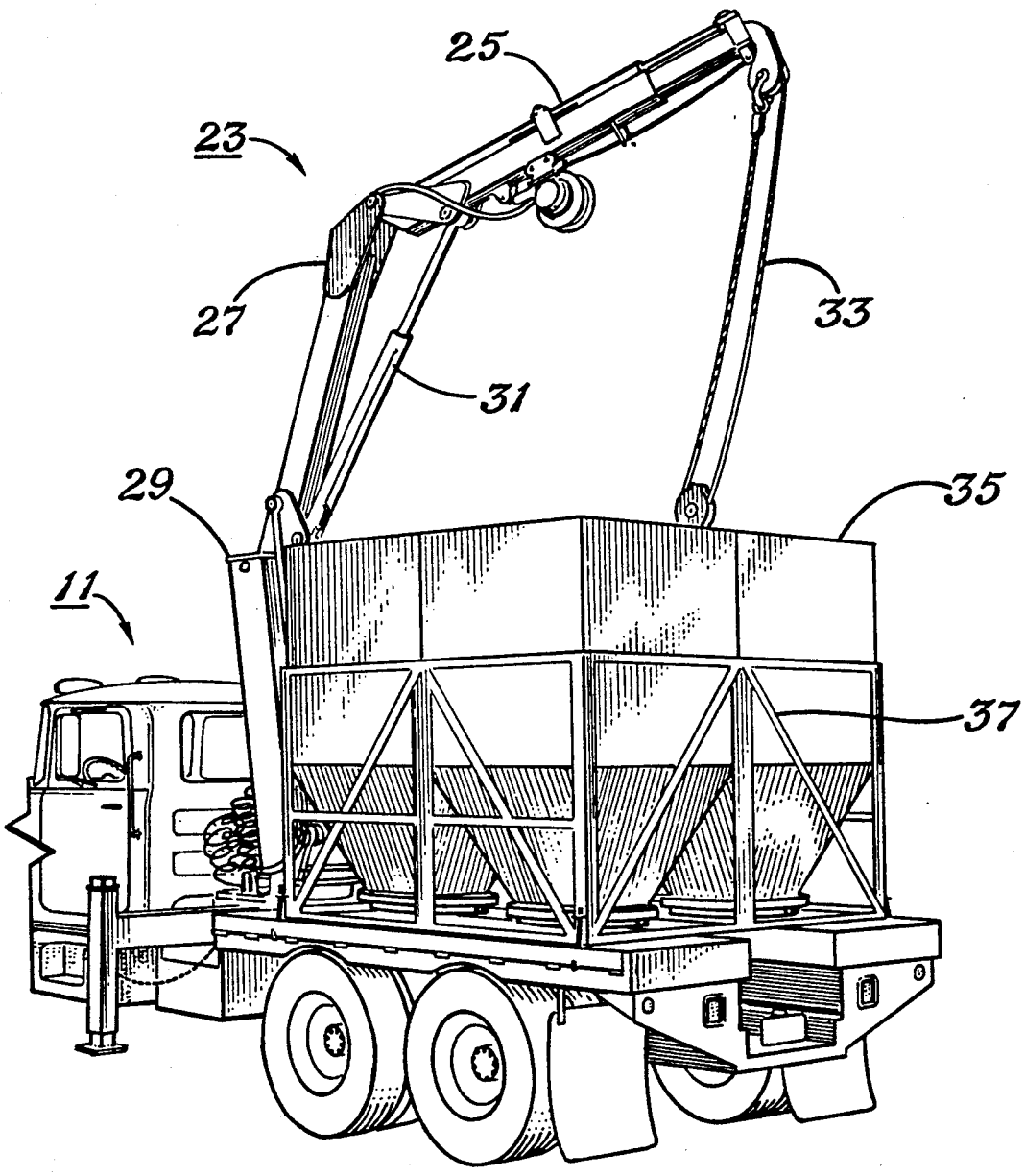
FIG. 2 is a perspective view of the truck of FIG. 1 showing a crane mounted on the truck and positioned to move cement silos used to provide cement to the portable machine of FIG. 1.

Mounted at an intermediate region of the truck is an extensible and rotatable crane 23, the operation of which is shown in FIG. 2. The crane 23 has articulated arms 25, 27 and 29 operated by hydraulic cylinders such as the one 31 between the arms 25 and 27. A cable 33 extends from the end of arm 25 downwardly to a selected one of the transport cement silos 35 of which there are four shown in FIG. 2. Thus, the truck 11 is used to transport the machine 13 to a construction site where the extensible legs 17 lift the machine from the truck, which truck may then be used to deliver cement by use of the crane 23 and silos 35 shown in FIG. 2.

Figure 3:
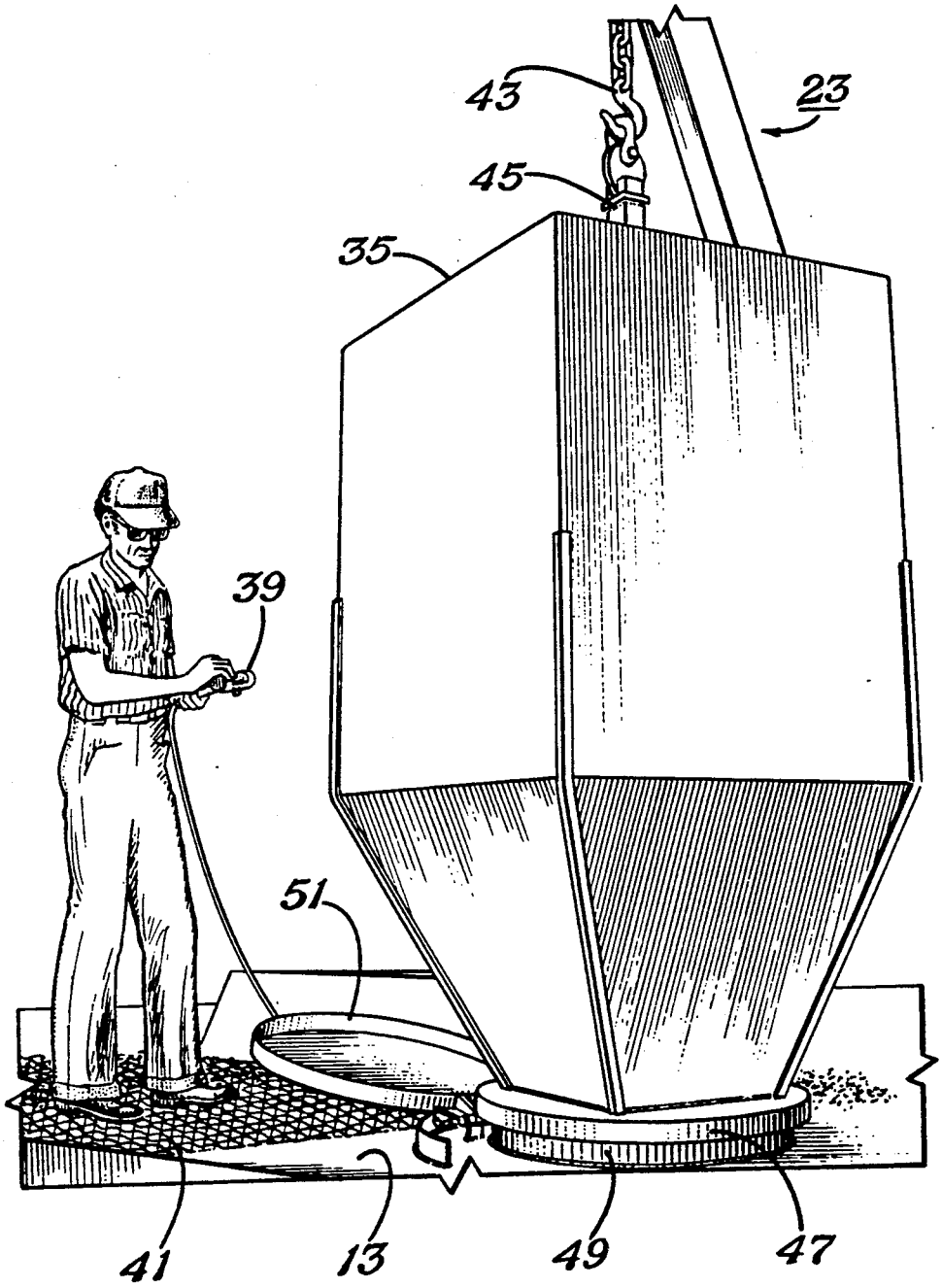
FIG. 3 is a perspective view of a portable cement silo being positioned by an operator on top the machine of FIG. 1.

As shown in FIG. 3, a hand held controller 39 is used in this instance by an operator who is standing on the top of the machine 13. The operator using the hand held controller 39 operates the crane 23 to lift and position a cement transport silo 35 by means of the cable supported hook 43 which supports the silo by its lift rod 45. The lower end of the silo has a flange 47 positioned over a registering opening 49 which is normally closed by a hinged lid 51.

Figure 4:
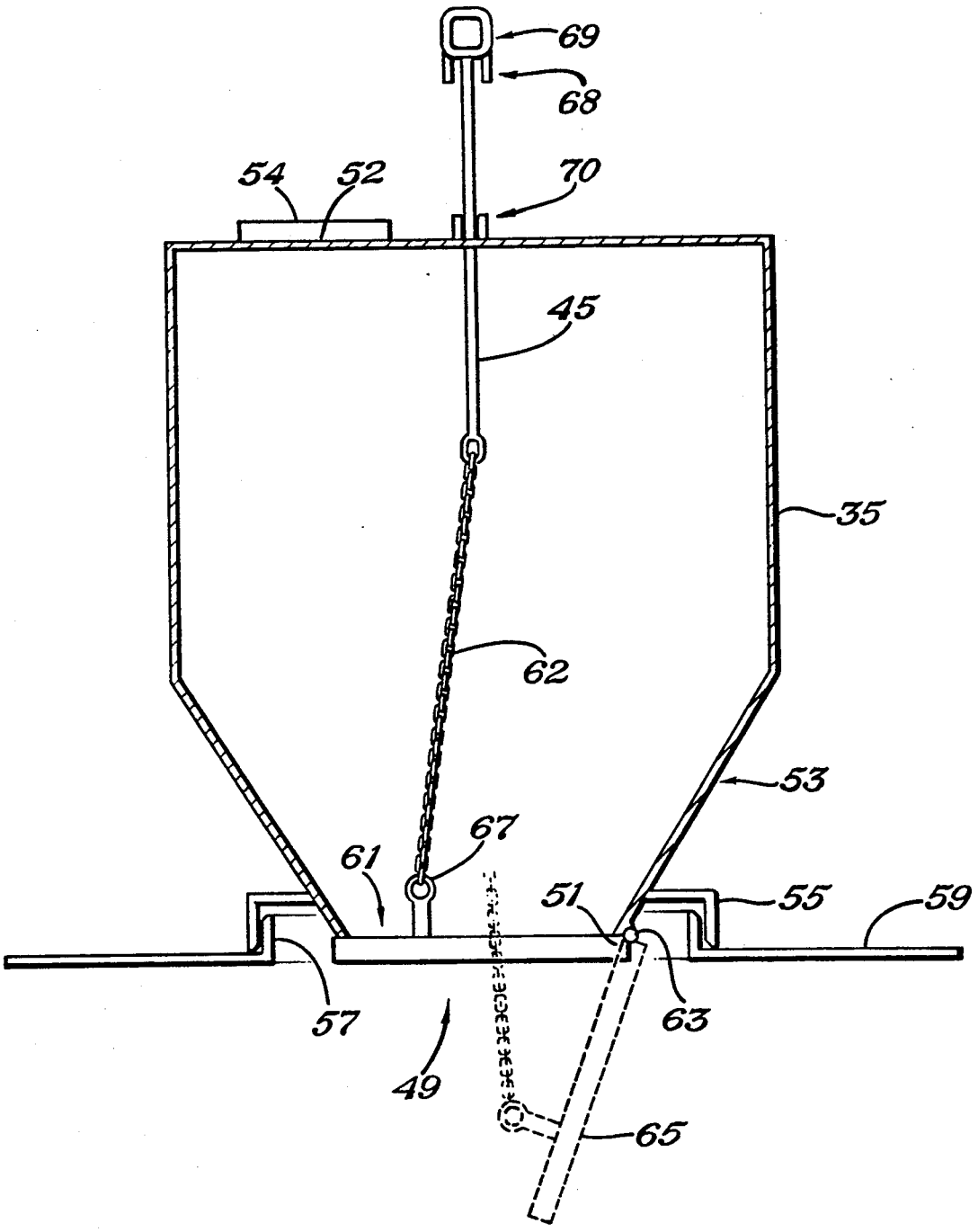
FIG. 4 is a longitudinal section of a portable cement silo.

The construction of the cement transport silo 35 is shown in the sectional view of FIG. 4 having an upper opening 52 covered by hinged lid 54. The lower end of the silo has a truncated conical section 53 having on its exterior a cylindrical guide portion 55 sized to register with the cylindrical wall 57 which extends upwardly from the top 59 of the machine 13 to form the previously mentioned opening 49. A plate 61 is sized to cover the opening at the bottom of the truncated conical section 53, being hinged at 63 on the peripheral such that it can assume an open position indicated in phantom by the numeral 65 to discharge cement. The plate 61 is held in a closed position by attachment of an extension of the lift rod 45 attached by a flexible connection 62 to the connector 67 in the interior, central portion of the plate. The upper portion of the lift rod has an eye 69 to receive the cable supported hook 43 shown in FIG. 3. The eye 69 has a depending bushing 68 that is circular in cross section to seal against a sleeve 70 to exclude water from the silo when tension is sufficiently released. Thus, the cement transport silo 35 can be positioned by crane 23 above the opening 49 and the tension removed from the lift rod 45 to permit the plate to assume the open, cement discharging, phantom position 65 shown in FIG. 4.

Figure 5:
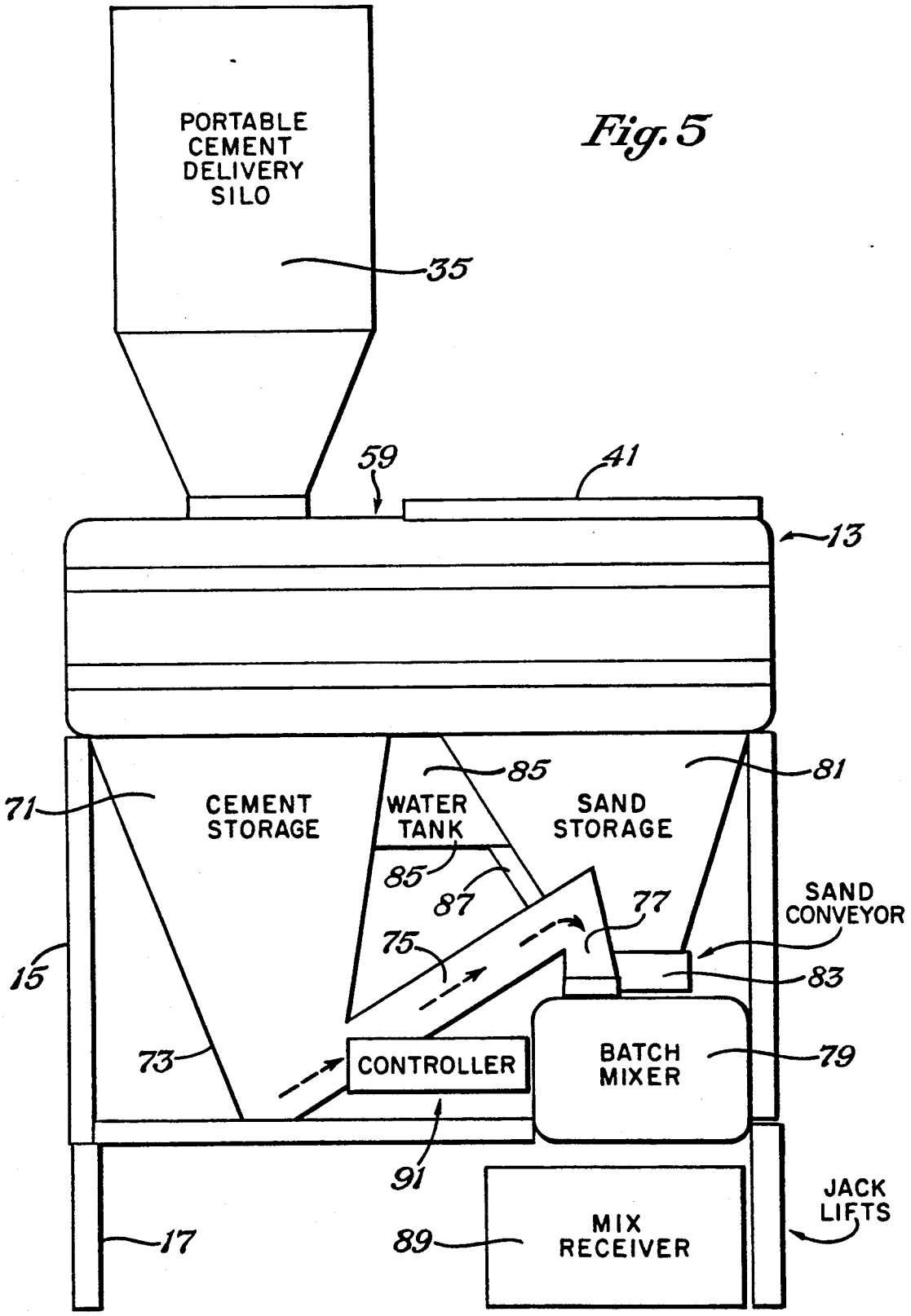
FIG. 5 is a schematic mechanical diagram of the machine of FIG. 1.

A mechanical schematic of the machine 13 is illustrated in FIG. 5 in which the frame 15 is shown supported by the extensible legs 17 after separation from the delivery truck 11 of FIG. 1. Positioned on top of the machine is the cement transport silo 35 in position to discharge through the top 59 cement into a cement into a cement storage and conveyor means 71 which consists in this instance of cement storage bin or hopper 73, conveyor 75 and discharge opening 77 through which cement passes into a batch mixer 79. A sand storage and conveyor means 81 is also supported on the frame 15 above a sand conveyor 83 which discharges sand into the batch mixer 79.

A water storage and conveyor or delivery means 85 delivers water through a valve means 87. The discharge of each of the above conveyor means is deposited on demand into a mix receiver 89.

Cement is delivered to the machine 13 by the cement transport silo 35, while sand is deposited by front end loader (not shown) or otherwise through the wire mesh 41 (see FIG. 9) which covers the opening above the sand storage and conveyor means 81.

Water is delivered to the tank 85 by connection to the local water source such as a city municipal water supply.

Figure 6:
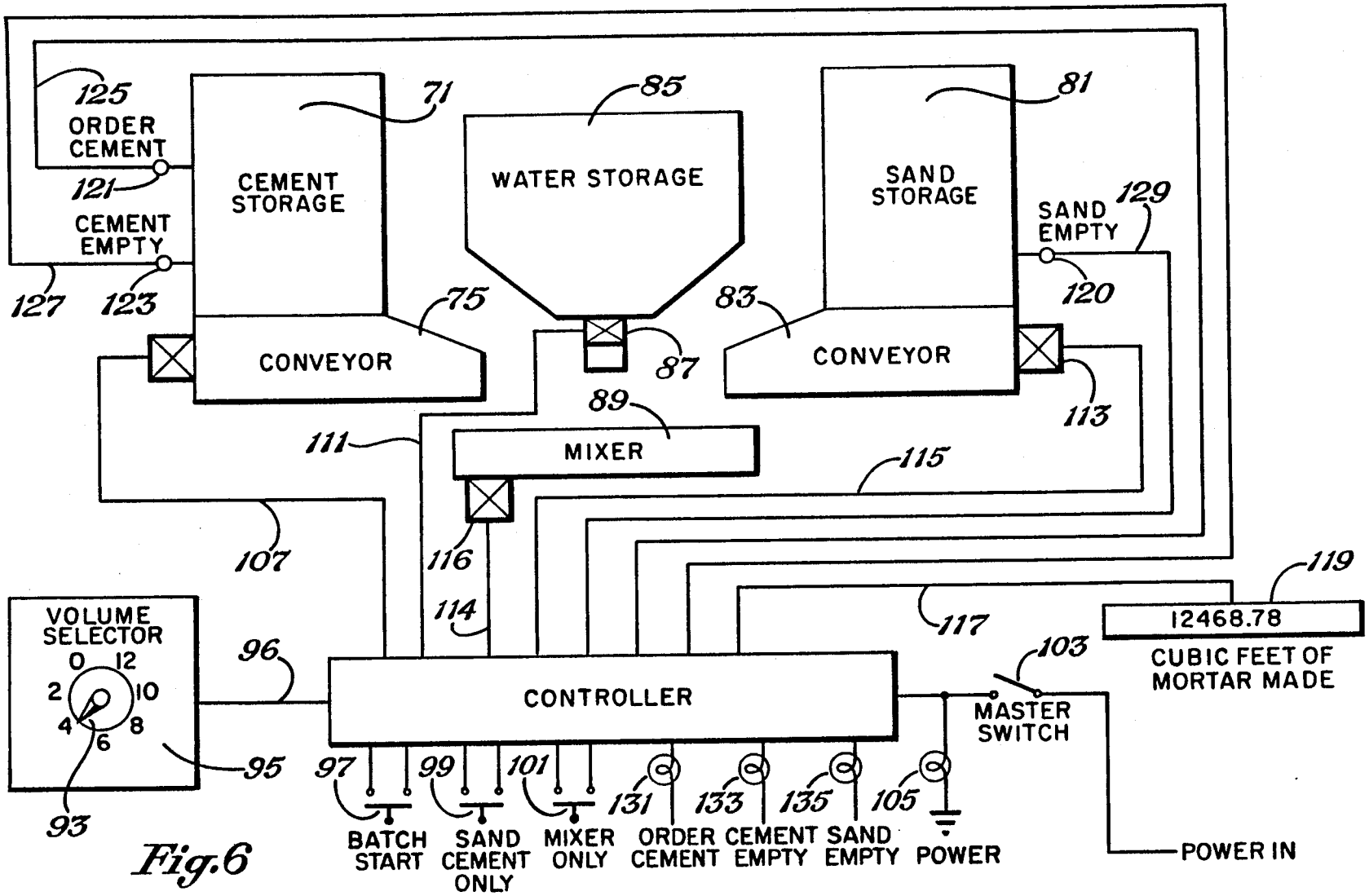
FIG. 6 is a schematic mechanical and electrical diagram of the machine of FIG. 1 to illustrate the preferred operator input and monitoring system.

Cementitious material such as mortar or grout is mixed to accurately predetermined ratios while giving the operator control over acceptable variations by use of a control system which is illustrated in FIG. 6. Here, the primary elements of the mechanical system illustrated in FIG. 5 are depicted schematically with identical reference numerals where possible. Each of the mechanical elements thus depicted is controlled by the control system which includes a controller 91. Those skilled in the art will appreciate that controller 91 may be an appropriately designed electromechanical controller or may, in an alternate embodiment of the present invention, constitute a properly programmed microprocessor. Coupled to controller 91 is a volume selector 93 which includes indices such as the numeral "4" which are designated at reference numeral 95. Volume selector 93 permits the operator to selectively determine the number of cubic feet of mixture of cementitious material which is produced within mixer 89. As can be seen, controller 91 includes a series of normally open momentary contact switches including: batch start switch 97; sand and cement only switch 99; mixer only switch 101; and, master switch 103, which when closed provides power for the operation of controller 91 and illuminates indicator lamp 105.

The operations of the various elements depicted in FIG. 5 are controlled by various outputs from controller 91. For example, output line 107 is utilized to control the operation of an electric motor 109 which may be utilized to drive conveyor 75. Similarly, output 111 may be connected with solenoid operated valve 87 which is utilized to control the output of fluid from water storage and delivery means 85. In like manner, a variable speed electric motor 113 may be utilized to drive sand conveyor 83 as controlled by output 115 and output 114 may be utilized to control the operation of electric motor 116 which operates mixer 89. Output indicator 119 is coupled to controller 91 of the output line 117 and may be utilized to monitor the total amount of delivery mix which has been produced utilizing the apparatus of the present invention.

An important feature of the present invention which is illustrated in FIG. 6 is the utilization of various sensing means to apprise the operator of the level of an associated constituent within its storage device. For example, within cement storage means 71 are sensor means indicated at reference numerals 121 and 123 which provide a signal indicative of level of cement present within cement storage means 71 by means of inputs 125 and 127 to controller 91. Similarly, sensor 120 may be utilized to sense the depletion of sand within sand storage means 81 and that information may be coupled to controller 91 through conductor 129. Also associated with controller 91 are indicator lamps 131, 133 and 135 which are utilized, in conjunction with sensors 121, 123 and 120 respectively, to indicate the level of cement or sand within the associated storage means. The information provided by sensors 121, 123 and 120 is then utilized, by controller 91, to prohibit the operation of the apparatus of the present invention unless sufficient constituents are present within the various storage means to permit the desired volume of cementitious mixture to be produced. In this manner, the operator may readily determine that the desired volume of cementitious mixture may be produced without the necessity of obtaining additional quantities of constituent ingredients.

Figure 7:
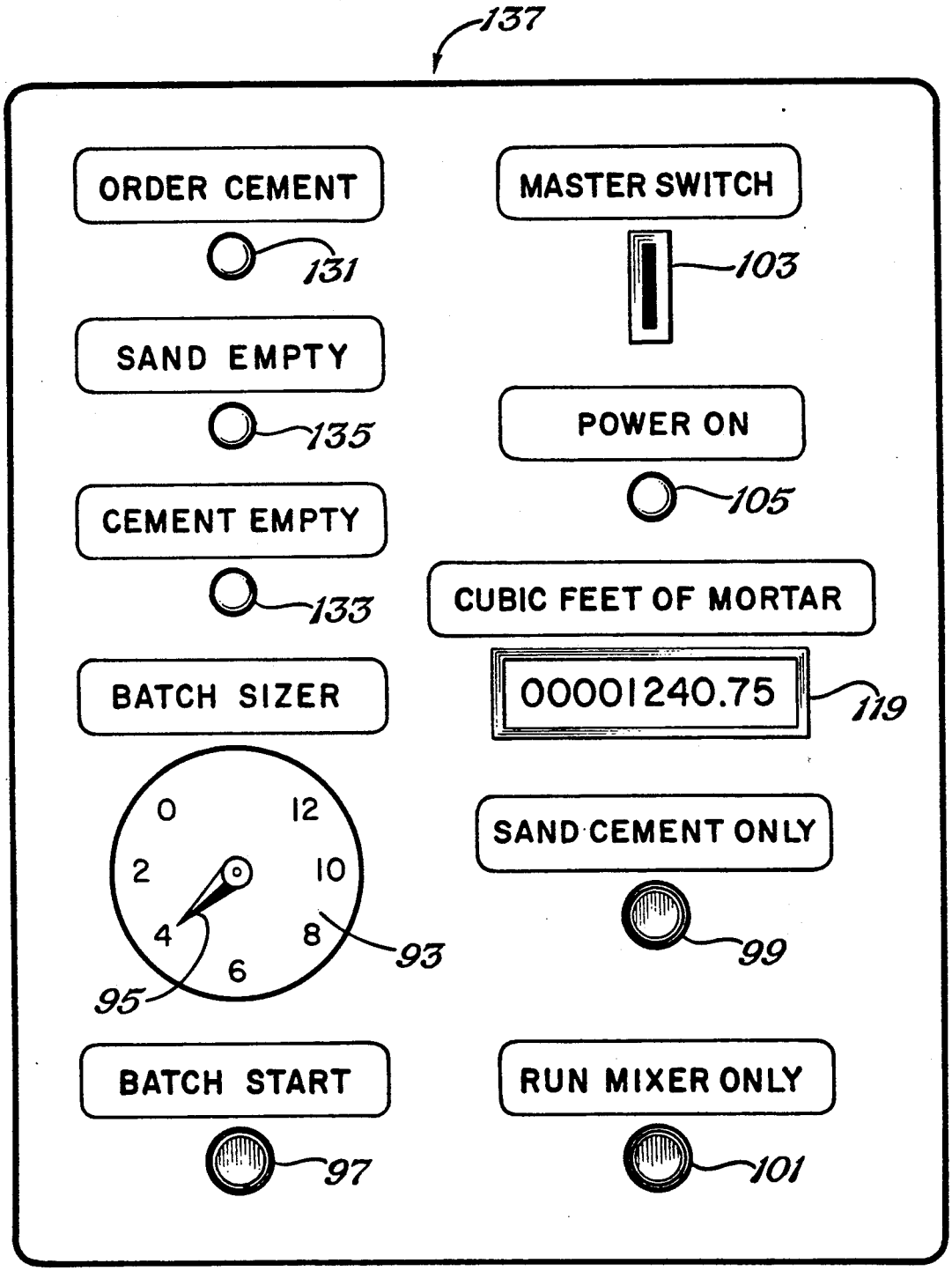
FIG. 7 is a view of the control panel associated with the operator input means of FIG. 6.

The various operator input means described above also include a control panel 137 which is depicted in FIG. 7 wherein the previously described switches and indicators may be conveniently mounted to provide a central location form which the apparatus of the present invention may be operated.

Figure 8:
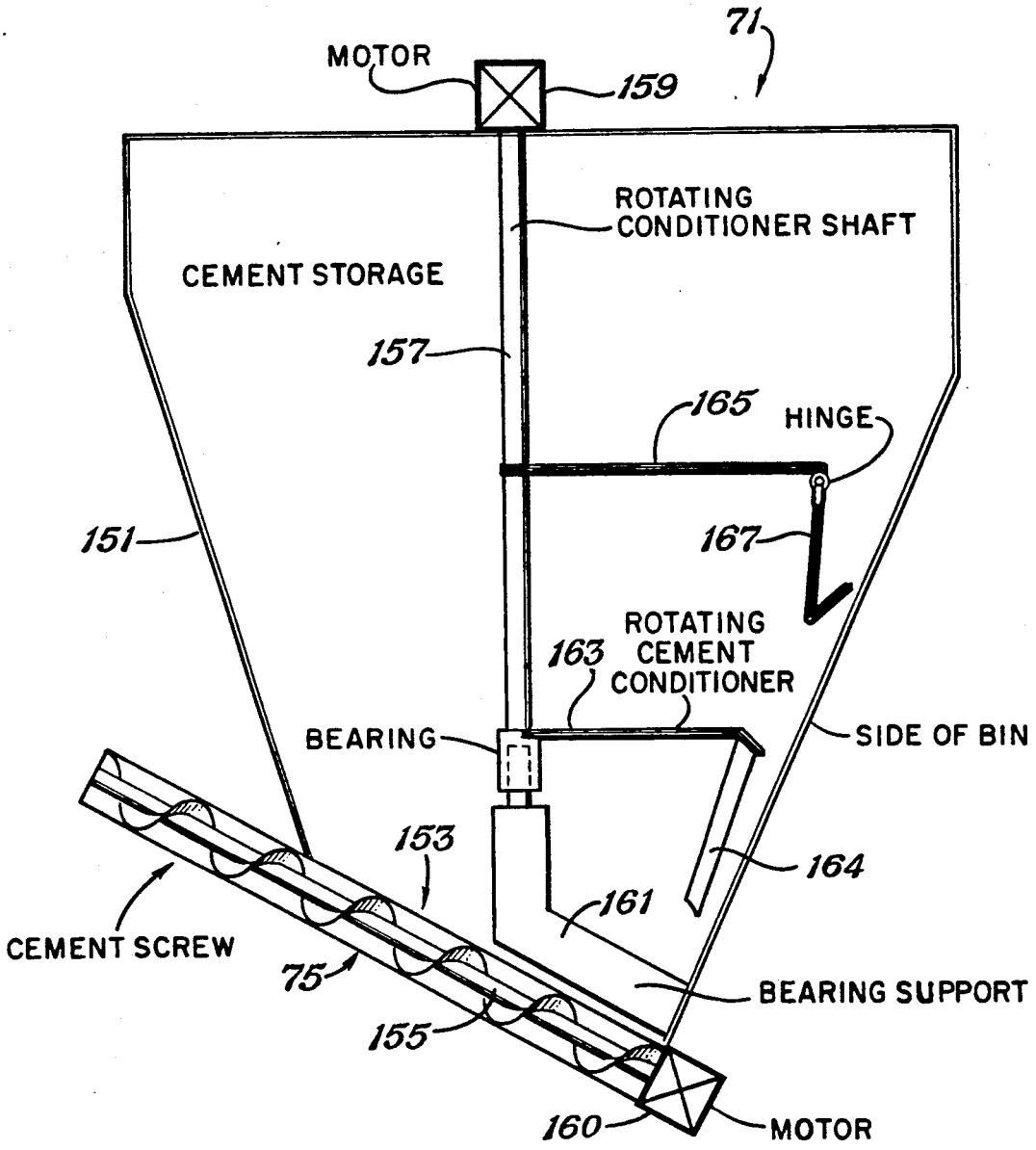
FIG. 8 is a schematic view of the cement storage and conveyor means.

It is often necessary to condition the cement to obtain uniformity of flow into the conveyor from the cement storage means. FIG. 8 illustrates schematically a longitudinal section of the cement storage and conveyor means 71 which consists of a hopper 151 which converges to an opening 153 above one end of an auger or screw conveyor 155. Centrally disposed in the hopper 151 is a rotating conditioner shaft 157 driven by an electric motor 159. Connected to a lower interior region of the hopper 151 is a bearing support brace 161 to support the lower end and the weight of the shaft 157. Extending outwardly from the lower end of the shaft 157 is a rotating cement conditioner arm or plate 163 having a blade 164 extending downward. In an intermediate region of the shaft 157 is rotating agitator arm 165 having at its end a hinged extension 167. The rotation of the shaft 157, the conditioner arm or plate 163, the agitator arm 165 and its hinged extension 167 assure a uniform and consistent flow of cement through the opening 153 and into the screw 155 of the conveyor 75 (add numeral 75 to the above description).

Figure 9:
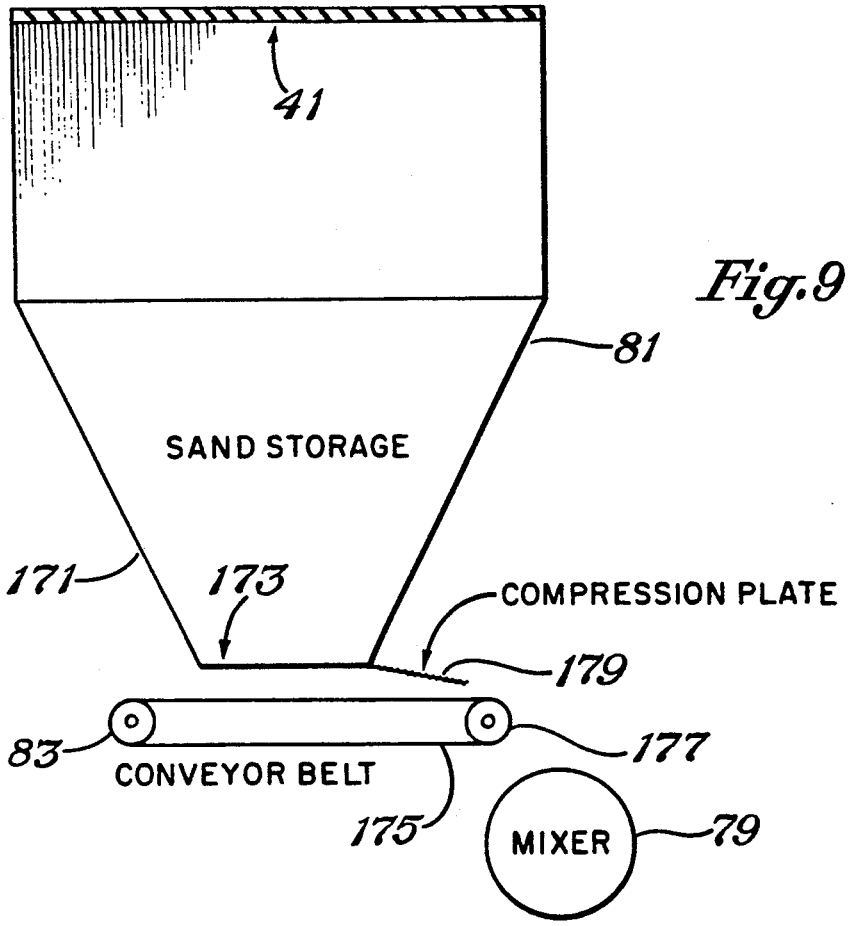
FIG. 9 is a schematic view of the sand storage and conveyor means and mixer to which the sand is delivered.

The delivery of sand at a uniformed flow rate and density is achieved with the sand storage and conveyor means 81 shown in FIG. 9. Here, the sand hopper 171 converges to an opening 173 above the conveyor 83 which is a belt 175 driven by one or more drive rollers 177. Before discharge from the belt into the batch mixer 79 the sand is compressed by a compressions plate 179, which assures a uniformed density of sand which may otherwise may tend to "fluff" or expand in the presence of moisture.

Figure 10:
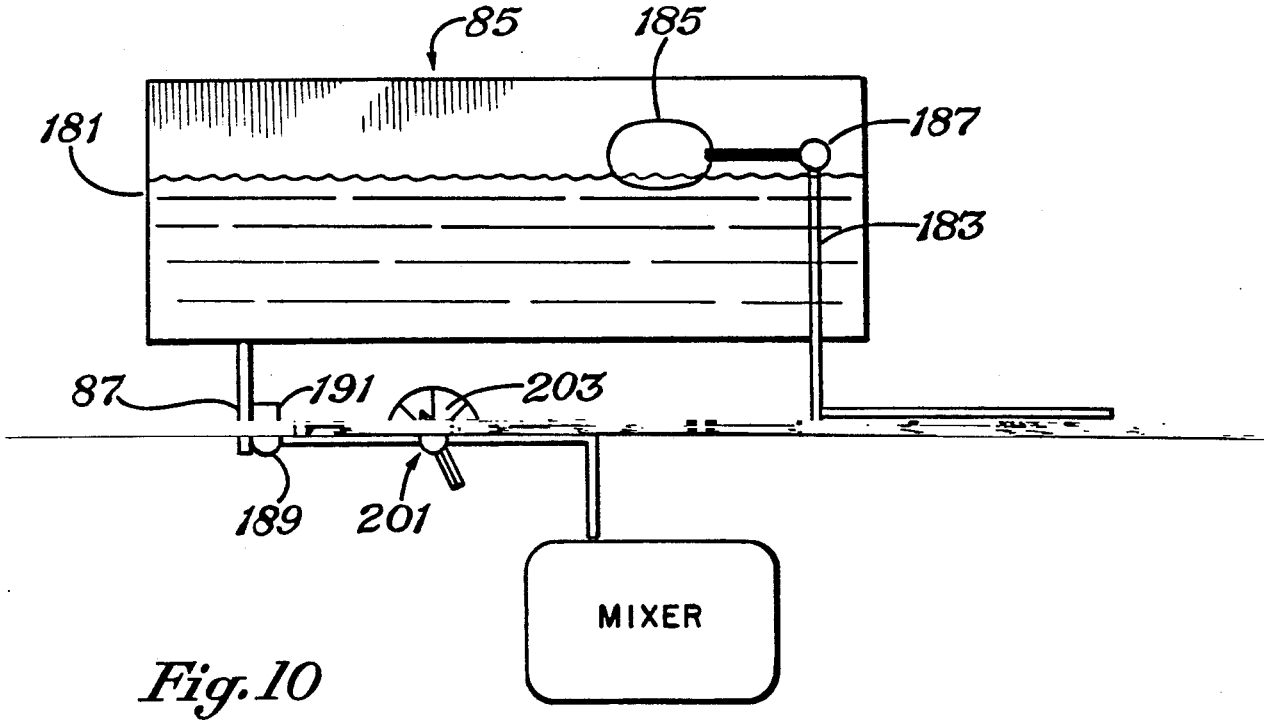
FIG. 10 is a water storage and conveyor means.
Figure 13:
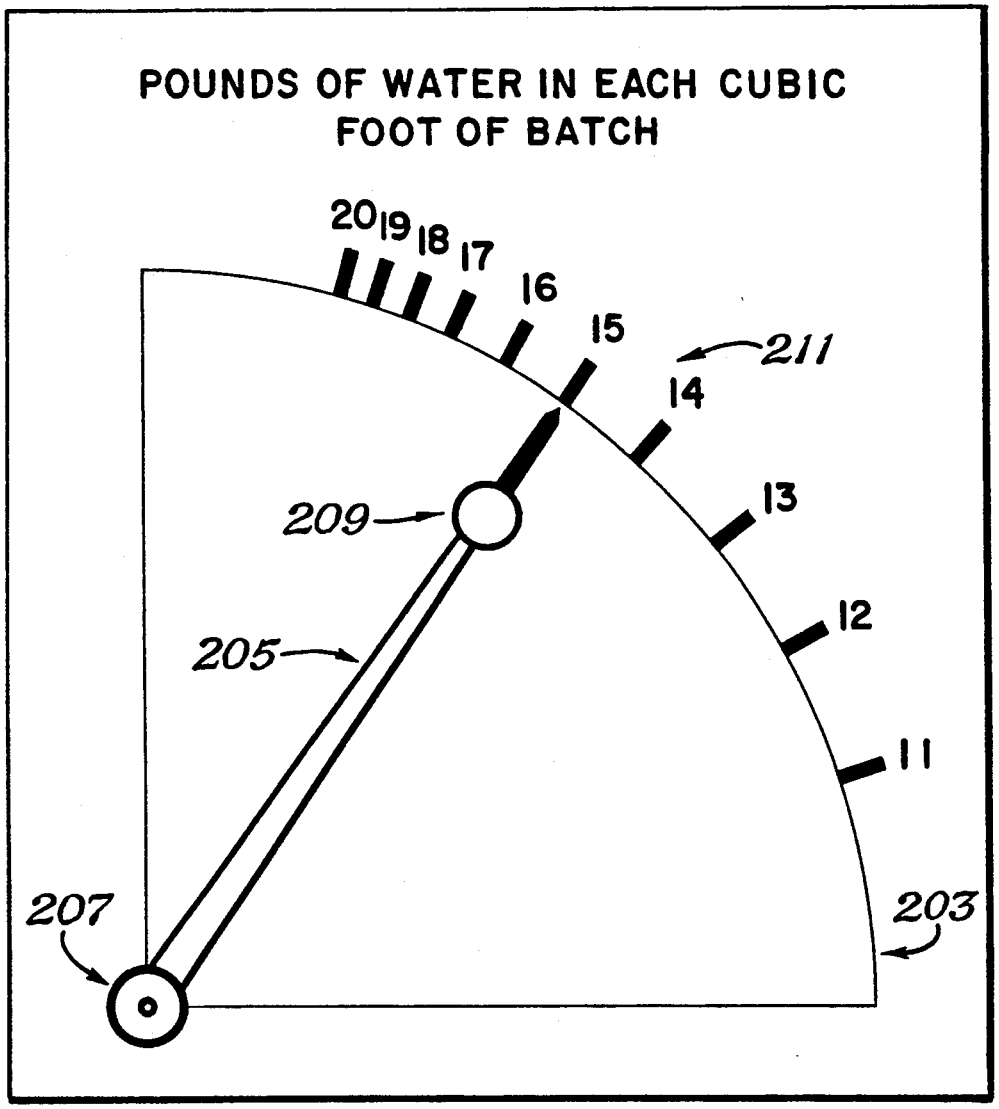
FIG. 13 is a front view of a controller used to determine the flow of water to the batch mixer.

As shown in FIG. 10, water is introduced to the cement/sand constituent through the water storage and delivery means 85 which consists of a tank 181 connected by conduit 183 through a water supply such as a conventional municipal supply. Water level in the tank 181 is sensed by a float 185 which controls the inlet valve 187. Thus, the operation of the float 185 and valve 187 maintains a constant level of water or head pressure at adjustment valve 201. Discharge from the tank 181 is controlled by the valve means 87 which consists of a valve 189 operated by a solenoid 191. An adjustment valve 201 is used to control the flow rate discharged from an open valve 189 and includes an indicator means 203 which the operator may use to select or adjust the quantity of water flowing into the batch mixer 89. The indicator means 203 is shown in better detail in FIG. 13 where an arm 205 is connected by a fastener 207 to the stem (not shown) of the adjustment valve 201. A handle 209 extends from the arm 205 to enable the operator to position the free end of the arm upon one of the indicia 211 which is indicative of the pounds of water per cubic feed of batch.

Figure 12:
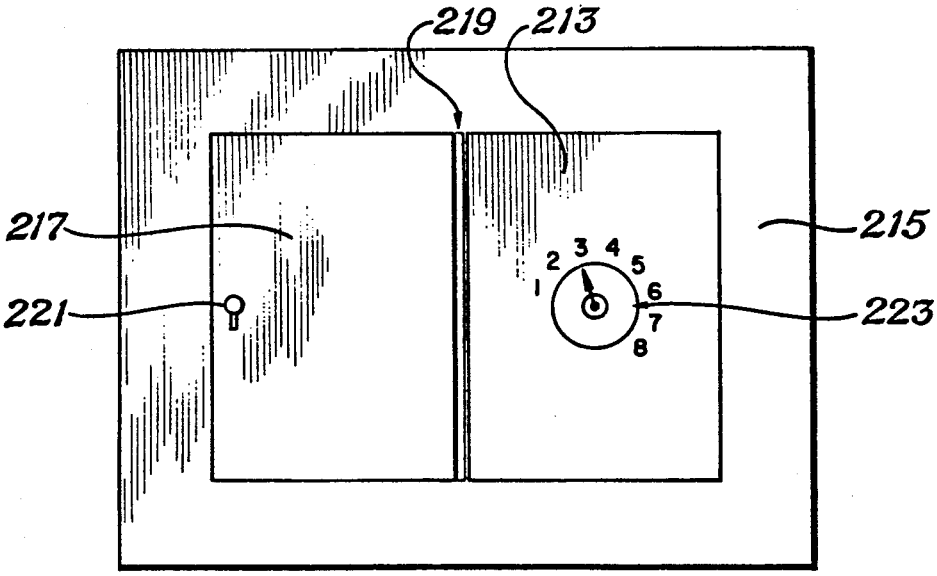
FIG. 12 is a front view of a supplemental, lockable controller to enable an operator to control the variable motor associated with the cement conveyor.

Additional control or potential control by the operator is provided by enabling variation of adjustment of the speed of operation and delivery rate of cement from the cement conveyor 75. The speed of rotation of the screw conveyor 155 shown in FIG. 8 is determined by the speed of rotation of the variable speed electric motor 109 (see FIG. 6). In FIG. 12 is shown a supplemental control panel 213 mounted on one wall 215 of the machine. This panel 213 is located behind a door 217, hinged at 219 and provided with a key operated lock 221 to prevent access to the control means 223 which operates a rheostat (not shown) to enable variation of power supply to the variable speed electric motor 109.

Figure 11:
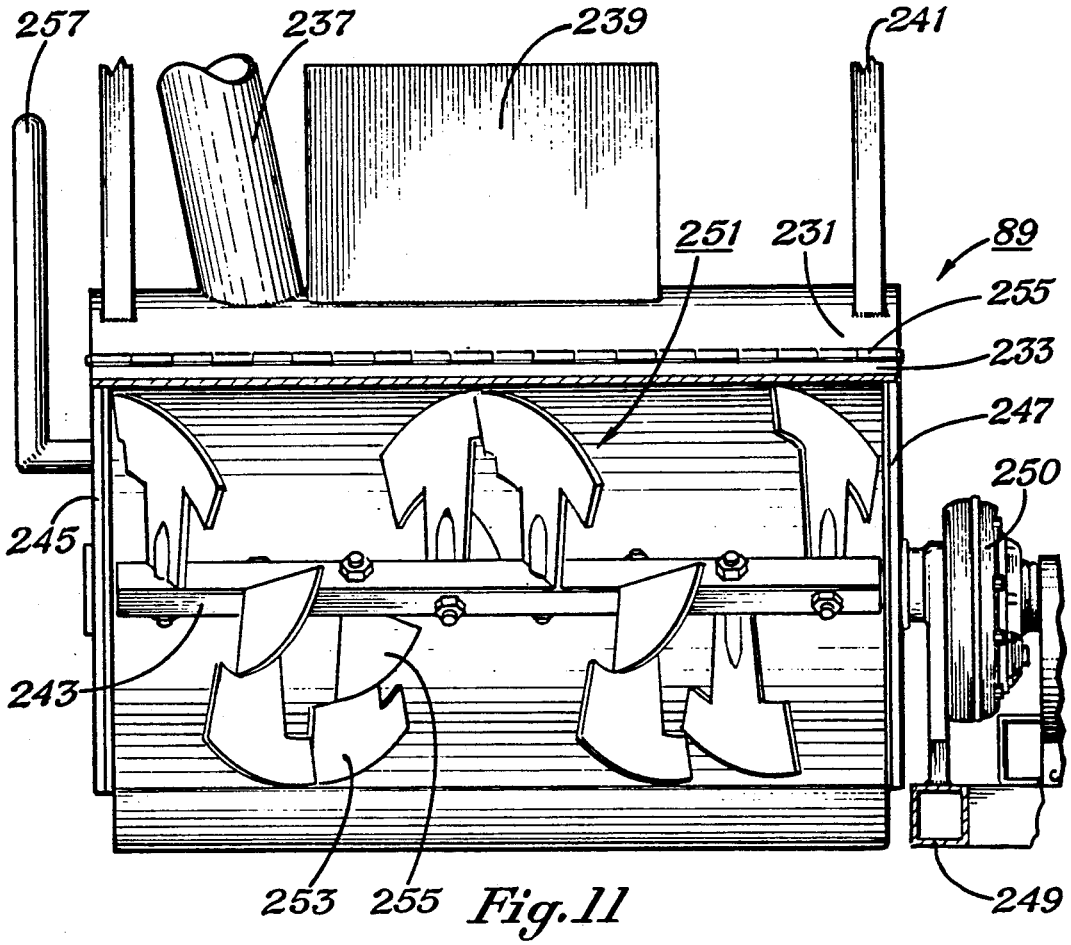
FIG. 11 is a front view of the batch mixer that receives and mixes constituents of cement, sand and waters.

The preferred form of the mix receiver 89 is a batch mixer shown in FIG. 11, which depicts a cylindrical container 231 having a door 233 hinged at 235, the door being broken away for clarity. Cement is deposited into the mixture through the conduit 237, while sand and water is introduced through a conduit 239. Suitable braces 241 are used to support the mixer on the machine (not shown). A central, horizontal shaft 243 extends between the endwalls 245, 247, being supported by bearings (not shown) and braces 249 and rotated by a speed reducer 250 connected with the electric motor 116 indicated schematically in FIG. 6. Secured to the central shaft 243 are a plurality of mixer arms 251 of which some have an outer portion 253 that moves mix to the right as seen in FIG. 11 and an inner portion 255 having an angle to move mix to the left. As a consequence, the constituents of cementitious material are moved in a horizontal rotational loop that extends from one end of the container to the other due to placement and angular orientation of the mixer arms 251. This has been found to produce a mix of exceptional uniformity and consistency.

In operation the truck 11 of FIG. 1 is used to transport the machine 13 to a construction site where the extensible legs 17 of frame 15 are extended until the footing engages the ground and the frame 15 is lifted to enable separation of the truck from the frame. Then, the truck is used to load the cement silo containment frame 37 above the opening 49. When tension is released from the lift rod 45, the plate 61 falls to the phantom position 65 shown in FIG. 4 to deposit cement into the cement storage 71. Then, the cement transport silo 35 is removed by the extensible crane 23 and the lid 51 shown in FIG. 3 closed to prevent contamination of the cement.

Sand is loaded on top of the machine through the wire mesh 41 shown in FIG. 5 to fill the sand storage sand means 81 of FIG. 9. Water is obtained by connecting the conduit 183 of FIG. 10 to a water source such as a city water supply.

Power is supplied to the various electrical components shown in the drawings, especially FIG. 6, by connection to a conventional power supply.

The operator of the machine then throws master switch 103 to energize the electrical circuit such that the operator can select the number of cubic feed of mix desired for the first batch by positioning the indicator 93 of volume selector 95 shown in FIGS. 6 and 7. The batch start switch 97 is depressed which supplies current to the electric motor 109 of the cement conveyor 75, the variable speed motor 113 of the sand conveyor 83 and to the solenoid operated valve means 87 associated with the water storage and delivery means 85. Simultaneously, current energizes the electrical motor 116 to rotate the mixer arms 251 of the batch mixer 79.

In the event the operator detects excessive amounts of moisture in the batch mixer, the sand cement only switch 99 is depressed to deposit only sand and cement in the mixer until the moisture balance is corrected. Should the operator determine that additional mixing is required, the run mixer only switch 101 is depressed, during which time energy is supplied to the mixer motor 116 but prevented from energizing the cement conveyor motor 109, the sand storage conveyor motor 113 or the electric solenoid operated valve 87 of the water storage and conveyor means 85.

Should the need for enriching future mixes with cement be determined, an operator entrusted with the key can open the door 217 to operate the control means 223 to vary the speed of the variable speed motor 109 associated with the cement conveyor 75.

At the conclusion of the mixing the ingredients may be removed by rotation of the batch mixer with handle 257. Additional batches may be mixed and delivered on demand. The operator can continue to mix and deliver selected quantities of mix by following the sequence of operations described above. Meanwhile, the total number of cubic feet of mortar are determined and indicated by the total volume indicator 119 shown in FIG. 7.

Depletion of cement is indicated by illumination of the order cement indicator 131 of FIG. 7, and similarly, depletion of sand is indicated by indicator 135. Should cement be depleted, the cement empty indicator 133 of FIG. 7 is energized and simultaneously powered to the system cut off. In addition, power supply interruption is indicated by the loss of illumination of the indicator 105.

Additional cement is provided to the system by the previously described use of the extensible crane 23 and cement transport silos 35. Additional sand is provided when needed by deposit with a front end loader through the wire mesh 41 of FIG. 3.

Is should be apparent from the foregoing that an invention of significant advantages has been provided. The provision of a machine or system for mixing cementitious material in a portable frame with extensible legs is advantageous in requiring only a relatively small truck. This truck serves the function of not only delivering the machine to the construction site, but also is used to deliver in a convenient form replacement cement. The use of a containment frame and multiple cement transport silos, all delivered by the truck, make the replenishment of cement extremely convenient. Relatively large volumes of sand and cement may be contained within the machine, which is small enough to be transported on all the major thoroughfares and under all standard size bridges.

The above described operator input means, which includes a volume selector, enables operator to select any volume of mix in a given range in a convenient manner. The cement storage and conveyor means is adapted with an agitator means to assure the delivery of a uniform and consistent cement to the batch mixer. Also, the use of a sand conveyor means which includes a compression plate to eliminate "fluff" assures the delivery of sand at a uniformed density to the batch mixer. The water storage and delivery means, with its constant water level tank, solenoid valve operation, and adjustment means, enables operator to control accurately the volume of water flowing to the batch mixer. In addition, the flow rate of cement can be controlled by one permitted to use the control means 223 associated with the supplemental control panel 213 of FIG. 12. The batch mixer 79 shown in FIG. 11 has proved exceptionally efficient in mixing constituents of cementitious material by the use of the mixer arms 251 with outer region 253 and inner region 255 that move the material in a rotational manner.

While the invention has been shown in only one of its forms, it should be apparent to those skilled in the art that it is not thus limited, but is susceptible to various changes and modifications without departing from the spirit thereof.

We claim:

1. In combination with an apparatus for mixing predetermined constituents of construction materials, including sand and cement, into selected volumes of mix using a batch mixer means fed by individual constituent storage and conveyor means, an improved controller and monitoring system which comprises:

operator input means, including a volume selector means, for permitting an operator to select any volume of mix in a given range;

each constituent storage and conveyor means being configured to provide during operation a constituent at a predetermined rate of flow to the batch mixer such that the ratio of constituents is substantially constant;

the constituent storage and conveyor means for the sand constituent including a hopper for the storage of sand and a belt conveyor to receive sand from the hopper;

a downwardly converging cement storage means supported on the frame;

a screw conveyor having an entrance connected with the lower end of the cement storage means and being responsive to said operator input means for delivering a predetermined volume of cement to the mixing means;

a water tank positioned above the mixing means connected with a water supply and including a water level sensor to maintain a constant pressure, with valve means for selection of the flow rate of water supplied to the mixing means;

controller means for operating each conveyor and storage means for a selected time interval within a given range;

said volume selector means communicating with the controller means for enabling operator selection of a volume of mix by establishing a corresponding time interval of operation of the conveyor and storage means.

2. The invention defined by claim 1 wherein the screw conveyor is driven by a variable speed electric motor for varying the ratio of cement to sand, with the motor being driven by a motor control means.

3. The invention defined by claim 2 wherein the operator input means further comprises a controller means having a sand and cement switch to deliver only sand and cement to the batch mixer for a selected time interval.

4. The invention defined by claim 3 in which the controller means has indicator means to inform an operator of the need to replenish cement and sand.

5. In combination with a portable machine to be delivered to a construction site for mixing constituents of sand, cement, and water into selected volumes of mix comprising:

support means for locating for portable machine at a construction site;

a power driven batch mixer for receiving a selected volume of the constituents and blending them into a combined mix, including means to discharge the resulting mixture on demand;

cement conveyor means for delivering a selected volume of cement constituent to the batch mixer;

sand conveyor means for delivering a selected volume of sand constituent to the batch mixer;

a storage means associated with each conveyor means and including input means to enable recharging of constituents on the construction site;

an operator controlled volume selector means for operating each of the conveyor means for a time interval corresponding with a selected volume to produce to an accurate volume of each constituent;

means to operate the batch mixer after the selected volume of constituents have been delivered to achieve a consistent and uniform mix, a cement silo containment frame adapted to be attached to a truck;

a selectable number of transportable cement silos adapted to fit within the containment frame;

lifting means for hoisting and locating the transportable cement silos into position over the portable machine in order to deposit and replenish into the constituent storage means cement that has been used by the machine.

6. A system for distributing a ready-to-use mixture of cementitious construction materials including cement, sand and water to a plurality of mixers at a plurality of job sites during a period of time comprising:

a road, container means transportable by the road vehicle for taking at least a portion of the particulate constituents to at least a plurality of the job sites;

a batch mixer transportable by the road vehicle to a selected job site where the respective batch mixer is placed during the period of time, the batch mixer including;

a batch mixing chamber for mixing quantities of each of the constituents to produce a batch of the ready-to-use cementitious material, bulk storage hoppers for storing a quantity of each of the particulate constituents greater than that used for each batch mix, means for delivering water to the mixing chamber, first means under control of an operator for selectively delivering a predetermined quantity of water and a predetermined quantity of each of the particulate constituents from the respective storage hoppers to the batch mixing chamber, second means under control of an operator for selectively delivering the mixed ready-to-use material from the mixing chamber as required by the user, whereby a single vehicle can be used to transport a plurality of batch mixers to multiple job sites and supply the plurality of batch mixers at the multiple job sites with bulk material for providing the ready to use mixture on demand at each respective job site.

7. The system of claim 6 wherein each mixer includes conveyor means for delivering particulate material from each storage hopper to the mixing chamber at a predetermined rate, and liquid dispensing means for delivering water to the mixing chamber at a predetermined rate, and said first means automatically, in response to operator initiation, operates each of the conveyor means for a preselected time to deliver a measured quantity of the respective particulate material to the mixing chamber and operates the liquid dispensing means for a predetermined time to deliver a predetermined volume of water to the mixing chamber.

8. The system of claim 7 wherein the control means includes operator selectable means for varying the quantities of particulate material and liquid automatically delivered to the mixing chamber while maintaining the relative proportions of each to selectively prepare different sized batches of the mixture as required by the user.

9. The system of claim 6 wherein there are a plurality of container means and each container means comprises a silo having an open top for filling the silos, controllable means for delivering the material from the bottom of the silo to the bulk storage means, and the vehicle includes means of lifting the silo from the vehicle and positioning it above the bulk storage hoppers to deliver the particulate material to the respective bulk storage hoppers.

10. The system claim 6 the bulk storage means are disposed above the respective conveyor means and the particulate material is delivered to the conveyor means by gravity, the mixture is delivered from the batch mixing chamber by gravity, and the batch mixing means is supported on extensible legs to permit the vehicle to be driven under the batch mixing means, the legs partially retracted to place the batch mixing means on the vehicle for transport, and partially retracted to place the batch means from the vehicle at the next construction site.

11. The system claim 6 wherein the container means includes a plurality of open topped silos each having a controllable bottom opening to dispense the particulate constituents by gravity, a rack for the plurality of silos placable on the vehicle for transporting the rack and silos over the road, the crane means mounted on the vehicle for selectively lifting each silo from the rack and positioning the silo over the bulk storage means for delivering the contents to one of the bulk storage means of the batch mixers where the batch mixers are placed in operating position on the ground.

12. The system of claim 6 further characterized by means for detecting a level condition for at least one of the constituents and displaying the condition for the operating whereby the constituent in the bulk storage means can be replenished before interruption of successive batch mixing operations.

13. The system of claim 6 wherein the particulate constituents are each delivered from the respective hopper means to the batch mixing chamber by separated conveyor means, and the control means includes;

proportioning means for selectively varying the speed of at least one conveyor means to calibrate the delivery rate of the respective particulate materials to the mixing chamber and establish the desired relative proportions of the particulate materials, operator selectable batch volume control means for allowing the operator to select the volume of the mixture to be mixed, the batch volume control means automatically operating the respective conveyor means for a time interval calculated to deliver the appropriate volumes of the respective particulate material to the batch mixing chamber.

14. The system claim 13 wherein the proportioning means for selectively varying the speed of at least one conveyor means is secured against unauthorized operation.

15. The system of claim 6 further comprising means responsive to the control means for accumulating the total volume of all batches produced at a job site.

16. The system of claim 6 wherein the control means includes means for monitoring the bulk supply of cement in the bulk storage hopper for cement and indicating when the supply is sufficiently low to order additional cement and further for indicating when the supply of cement is below that required for the next mixing batch.

17. The system of claim 6 further characterized by means for selectively varying the volume of water automatically delivered to the mixing chamber for each cubic volume of particulate mixture delivered to the mixing chamber to vary the resulting water content of the batch of preselected volumes.

18. An apparatus for mixing predetermined constituents of construction materials, including sand and cement, in a batch mixer having desired volume of mix selected from a range of volumes comprising:

a batch mixer for mixing a batch of cementitious material having predetermined volumetric size;

an operator control means including a volume selector input means for an operator select a desired total volume of cementitious material to be mixed by the batch mixer from a range of available batch sizes, the operator control means being responsive to the volume selector means for automatically controlling delivery of necessary quantities of constituents for the batch of cementitious material to a batch mixer and mixing of a batch of cementitious material in the selected desired total volume with predetermined proportions of constituents;

downwardly converging sand storage means and a first conveyor having an entrance connected with a lower end of the sand storage means for creating a relatively consistent volumetric flow of sand, the first conveyor being responsive to the control means for operating at a predetermined speed to produce a predetermined volumetric flow of sand for a predetermined time interval, the operator control means determining the predetermined time interval for operation of the conveyor to deliver at the predetermined volumetric flow rate a volume of sand in predetermined proportion to the selected desired total volume of the batch of cementitious material;

downwardly converging cement storage means and a second conveyor having an entrance connected with a lower end of the cement storage means for creating a relatively consistent volumetric flow of cement, the second conveyor being responsive to the operator control means for operating at a predetermined speed to produce a predetermined volumetric flow of cement for a predetermined time interval, the control means determining the time interval for operation of the second conveyor to deliver at the predetermined volumetric flow rate a volume of cement in predetermined proportion to the selected desired total volume of the batch of cementitious material; and means for automatically delivering a predetermined volume of water to the batch mixer in predetermined proportion to be desired total volume of the batch of cementitious material.

19. The apparatus of claim 18 wherein one of said and second conveyors is driven by a variable speed electric motor for varying the volumetric flow rate of the material delivered by the conveyor and thereby the ratio of cement to sand in the batch of cementitious material the operator control means responsive to a ratio selection means for allowing an operator to select a type of cementitious material to be mixed by the batch mixer.

20. The apparatus of claim 18 wherein the operator control means further comprises operator input means initiating operation of the first and second conveyors and the means for delivering water simultaneously.

21. The apparatus of claim 18 wherein the operator control means includes indicator means to inform an operator of the need to replenish a cement in the cement storage means and sand in the sand storage means.

22. The apparatus of claim 18 wherein the operator control means further includes a sand and cement only switch means under control of an operator to operate the first and second conveyors to deliver only sand and cement without water to the batch mixer for a time interval determined by the operator.

23. The apparatus of claim 22 wherein the operator control means further includes a switch means under control of the operator to operate the batch mixer independently.

24. The apparatus of claim 18 wherein the cement storage means includes a cement conditioner means to fluff cement stored therein to thereby provide consistent flow of cement into the entrance of the second conveyor and thereby provide for a continuous volumetric flow of cement.

25. The apparatus of claim 18 wherein the means for automatically delivering water is responsive to the operator control means, the operator control means determining the volume of water based on the selected total volume of the batch of cementitious material.

26. A method of accurately and thoroughly mixing a batch of cementitious material having a selected volume and predetermined ratio of sand, cement and water, suitable for use at a construction site, the method comprising the steps of:

providing at the construction site a batch mixer for mixing as a batch cementitious material and having a predetermined range of mixing volumes, a downwardly converging cement storage means and a cement conveyor means cooperating the cement storage means to create a predetermined rate of volumetric flow of cement from the cement supply means to the batch mixer, a downwardly converging sand storage means and sand conveyor cooperating with the sand storage means to create a predetermined rate of volumetric flow of sand between the sand storage means and the batch mixer, and a water supply for delivering selectable volumes of water to the batch mixer;

providing for storage of bulk amounts of cement in the cement storage means and sand in the sand storage means in order to mix a batch of cementitious material when needed over a given period of time without the need to replenish the cement and sand after each mixing and to safely store the material at the construction site;

providing operator preselection of a desired total batch volume of cementitious material from a range of a batch sizes of cementitious material to be mixed as a batch by the batch mixer under control of a control means, the control means determining a time interval of operation of the cement conveyor and the sand conveyor corresponding to the selected desired total volume to deliver to the batch mixer at the respective predetermined volumetric rates volumes of the sand and the cement to create a batch of cementitious material in the batch mixer having a predetermined ratio and the desired total volume;

providing automatic operation with the control means of the cement conveyor and the sand conveyor for the determined time interval;

providing automatic operation of the water supply to deliver a volume of water for the preselected desired total volume of the batch of cementitious material; and providing operation with the control means of the batch mixer to mix the delivered constituents.

27. The method of claim 26 further comprising the step of providing a selection of ratios of constituents desired for a batch of cementitious material to be mixed with a selector means, determination with the control means of the rates of volumetric flow of the cement and sand and the water corresponding to the desired ratio of constituents, and operation of the cement conveyor and the sand conveyor at the determined volumetric rates by the control means.

28. The method of claim 26 further comprising the step of providing for operation of the cement conveyor and sand conveyor for a time determined by a operator to deliver additional cement and sand in the predetermined ratio to the batch mixer in the event that the cementitious material being mixed is too wet.

29. The method of claim 26 further comprising the step of providing for operation of the operation the cement conveyor means, the sand conveyor means, the water supply and the batch mixer to produce a batch of cementitious material with a single button.

30. The method of claim 26 further comprising the step of providing means for informing a user when cement in the cement supply means should be replenished and when the sand in the supply means should be replenished.

31. The method of claim 26 further including the step of providing for conditioning the cement in the cement storage means prior to operation of the cement conveyor to provide for consistent cement flow from the cement storage means to the cement conveyor.

* * * * *

UNITED STATES PATENT AND TRADEMARK OFFICE

CERTIFICATE OF CORRECTION

PATENT NO. : 5,149,192

DATED : September 22, 1992

INVENTOR(S) : Alton B. Hamm and Grover C. Ratliff

It is certified that error appears in the above-identified patent and that said Letters Patent is hereby corrected as shown below:

Column 2, line 26, delete "objections" and insert -- objects --.

Column 3, line 57, delete "into a cement".

Column 5, line 12, delete "form" and insert -- from --.

Column 6, line 59, delete "feed" and insert -- feet --.

Column 7, line 37, delete "Is" and insert -- It --.

Column 8, line 65, delete "for", second occurrence.

Column 9, line 13, delete "to".

Column 9, line 30, insert -- vehicle, -- after "road", first occurrence.

Column 10, line 20, insert -- of -- after "system".

Column 10, line 20, insert -- wherein -- after "6".

Column 10, line 31, insert -- of -- after "system".

UNITED STATES PATENT AND TRADEMARK OFFICE

CERTIFICATE OF CORRECTION

PATENT NO. : 5,149,192

DATED : September 22, 1992

INVENTOR(S) : Alton B. Hamm and Grover C. Ratliff

It is certified that error appears in the above-identified patent and that said Letters Patent is hereby corrected as shown below:

Column 10, line 45, delete "operating" and insert -- operator --.

Column 10, line 66, insert -- of -- after "system".

Column 11, line 26, insert -- to -- after "operator".

Column 12, line 1, insert -- first -- after "said".

Column 12, line 5, insert -- , -- after "material".

Column 12, line 66, delete "a".

Signed and Sealed this

Fifth Day of October, 1993

Bruce Lehman

*Attest:*

BRUCE LEHMAN

*Attesting Officer*

*Commissioner of Patents and Trademarks*